United States Patent [19]

King

[11] 4,250,399

[45] Feb. 10, 1981

[54] ELECTRIC HEATING ELEMENTS

[75] Inventor: Reynold C. King, Wytheville, Va.

[73] Assignee: Emerson Electric Co., St. Louis, Mo.

[21] Appl. No.: 1,558

[22] Filed: Jan. 22, 1979

[51] Int. Cl.[3] ..... H05B 3/06

[52] U.S. Cl. ..... 219/532; 174/138 J; 219/536; 219/546; 338/299

[58] Field of Search ..... 219/532, 536, 537, 546, 219/550; 174/138 J; 29/611; 338/299, 317, 318; 13/25

[56] References Cited

U.S. PATENT DOCUMENTS

| | | | |
|---|---|---|---|
| 1,419,309 | 6/1922 | Russell | 219/532 |
| 1,695,801 | 12/1928 | Dibble | 219/532 |
| 3,691,348 | 9/1972 | Kunz | 219/532 |
| 3,846,619 | 11/1974 | Wightman | 219/532 |
| 3,890,487 | 6/1975 | Wightman | 219/532 |
| 3,992,609 | 11/1976 | Alexander | 219/532 |

FOREIGN PATENT DOCUMENTS

| | | | |
|---|---|---|---|
| 214058 | 4/1924 | United Kingdom | 219/532 |
| 1003610 | 9/1965 | United Kingdom | 219/532 |

*Primary Examiner*—Volodymyr Y. Mayewsky
*Attorney, Agent, or Firm*—Michael Williams

[57] ABSTRACT

An open coil electric heater comprising a rigid support frame composed of a pair of longitudinally extending, laterally spaced members, with cross members between and secured to the longitudinal members. The cross members carry ceramic coil supports which are detachably connected to the cross members. Each coil support has an end formed with a cross slot to pass a part of a convolution of a coil and hook-like projections are formed on opposite sides of a coil support and are cooperable with the coil convolution part to detachably hold the same to the coil support. The heating coil is secured to the coil supports in expeditious manner and without the use of tools by twisting the coil so that said convolution part is aligned sufficiently with said cross slot to enable said part to be seated within said slot. The coil is then permitted to spring back so that the convolution fits against opposite side faces of said coil support and held in position by said hook-like projections.

5 Claims, 8 Drawing Figures

ELECTRIC HEATING ELEMENTS

BACKGROUND AND SUMMARY

In U.S. Pat. No. 3,846,619, issued to Lawrence W. Wightman et al on Nov. 5, 1974, and assigned to the assignee of the instant application, there is disclosed on open coil electric heater along the lines of that herein disclosed. The ceramic coil supports in said patent have ends configured to receive and hold metal clips and the latter are formed to receive and hold a part of a convolution of the coiled resistance wire. It has been found that the Wightman structure is relatively expensive to manufacture since the metal clips are of intricate design and therefore require expensive blanking and forming dies. In addition to representing an additional part, the metal clips required labor in their assembly with the ceramic support. Further, since the clips were of metal, care had to be exercised in their composition in order to prevent electrical shorting between reaches of the resistor coil. Also, as described in the Wightman patent, adjoining flanges formed on the metal clip had to be forced apart to enable the wire turn to enter a receiving channel, and this provided complicated assembly procedure.

While retaining some of the advantages of the Wightman assembly, the construction herein disclosed greatly reduces the cost of the assembly by molding ceramic coil supports to provide an end with a cross slot to pass and receive a part of a convolution of the heating coil, opposite faces of the coil support end having hook-like projections adapted to engage the captured coil convolution and hold it in assembled relation.

DESCRIPTION OF THE DRAWINGS

In the drawings accompanying this specification and forming a part of this applicaton there is shown, for purpose of illustration, an embodiment of my invention, and in these drawings.

DESCRIPTION OF THE PREFERRED EMBODIMENT

Figure 1:
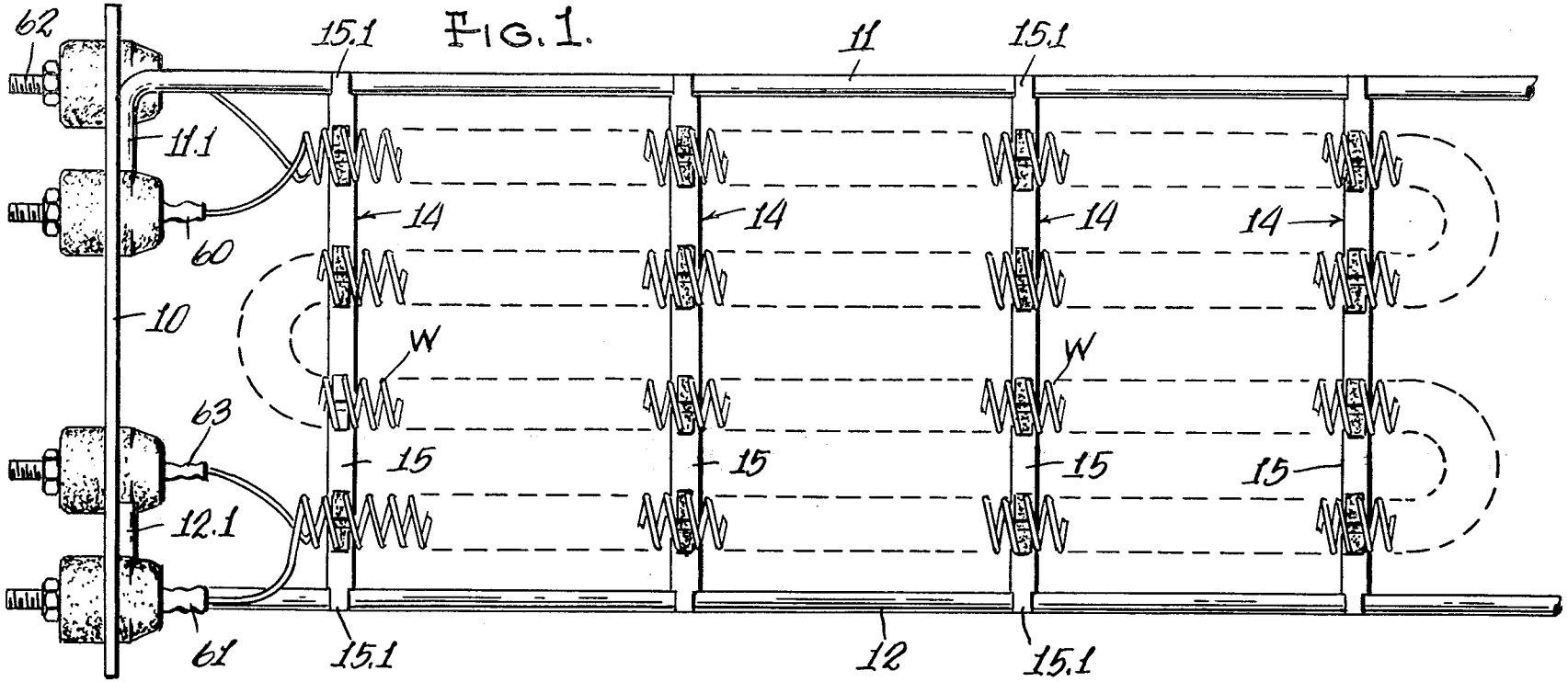
FIG. 1 is a top plan view of an open coil electric heating element in which my invention is embodied, the view being drawn to a slightly reduced size.
Figure 2:
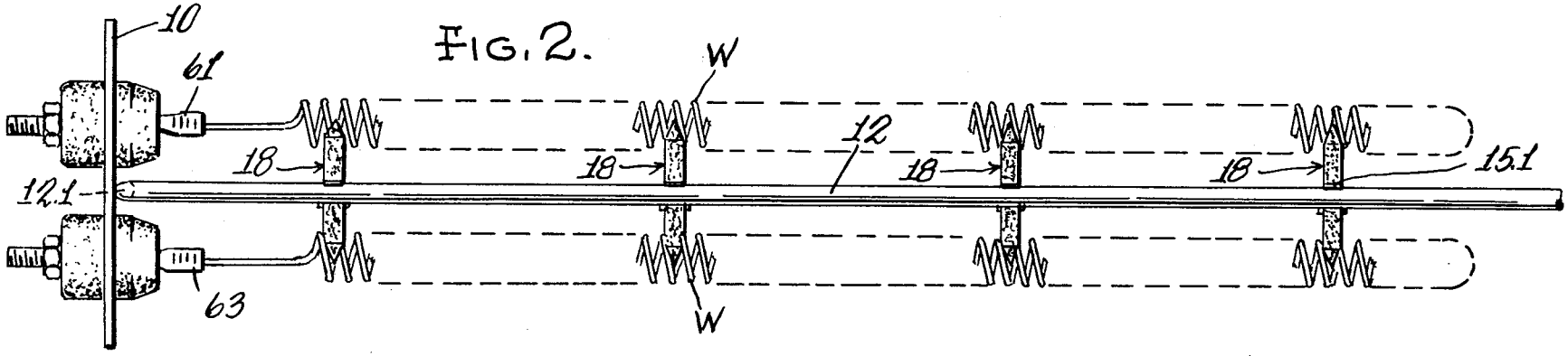
FIG. 2 is a side elevational view of the heater shown in FIG. 1.

As seen in FIGS. 1 and 2, the assembly includes a sheet-metal mounting plate 10 by which the heater may be mounted on any suitable support. A pair of steel rods 11–12 are connected to the mounting plate to extend therefrom in a common plane and in parallel, laterally-spaced relation. This connection may be effected by welding angularly disposed legs 11.1 and 12.1 of the rods to the plate.

Figure 4:
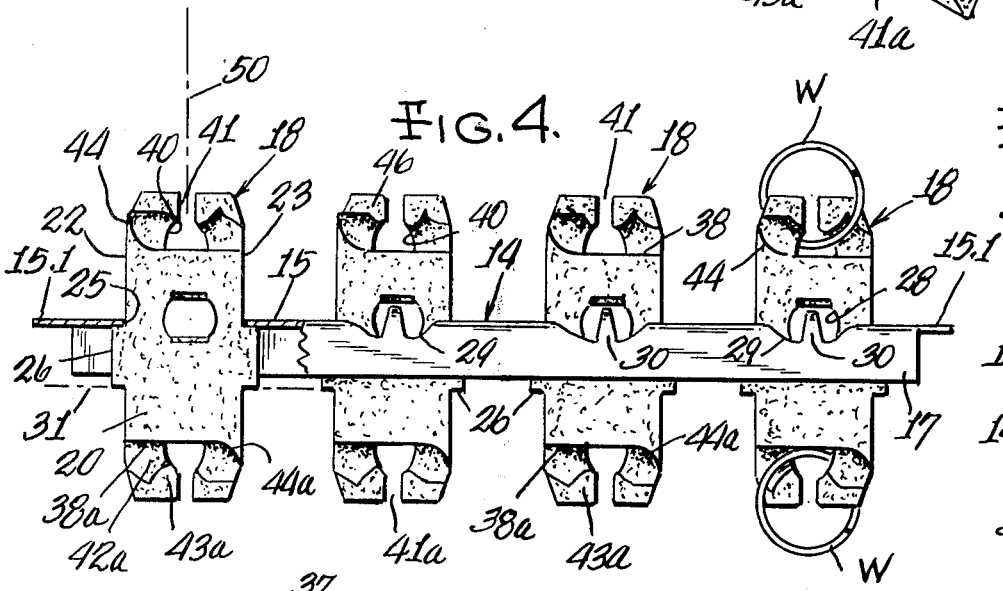
FIG. 4 is a side view of a sub-assembly, with parts in section.
Figure 5:
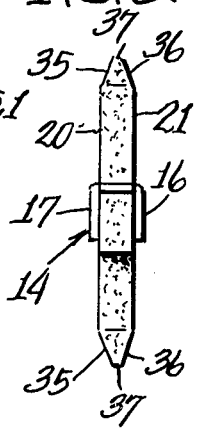
FIG. 5 is an end elevational view of the sub-assembly.

A plurality of cross arms 14 are connected across the rods 11–12. All cross arms are the same and detailed description of one will suffice for all. As seen in FIGS. 4 and 5, each cross arm is U-shaped in cross section and connected to the rods in inverted relation to provide a top wall 15 constituting the bight of the U and spaced side walls 16 and 17 extending downwardly from the bight. The top wall 15 is extended at opposite ends to provide tabs 15.1 which are welded to respective rods 11–12.

Each cross arm 14 is constructed and arranged to support one or more coil supports or insulators 18, and in the embodiment herein disclosed each arm supports four insulators. Each insulator is in the form of an oblong body formed of molded ceramic material, or any other suitable rigid insulating material. Each insulator is preferably rectangular in cross section to provide parallel opposite flat sides 20 and 21 and parallel opposite ends 22 and 23.

The top wall 15 of a cross arm 14 is formed with rectangular openings 25 in spaced relation lengthwise of the arm, each opening being slightly larger than the cross section of an insulator to closely receive the latter. Each insulator has lugs 26 extending from opposite ends of the same, about midway of the length of the insulator. The lugs 26 are for the purpose of engaging the inner surface of the top wall 15 to limit projection of an insulator 18 through an opening 25 to a predetermined amount, as shown in the left-hand end of FIG. 4.

An opening 28 is formed in the body of each insulator 18 in predetermined relation with the end lugs 26 thereof. The wall 17 of the support arm is provided with scalloped recesses 29 in line with respective insulator openings 28 and a finger 30, integral with the front wall 17, is adapted to be pressed into the opening 28 to lock the insulator in place. Each support arm 14, with its connected insulators, may be formed as a sub-assembly before the end tabs 15.1 are welded to the rods 11–12.

Figure 3:
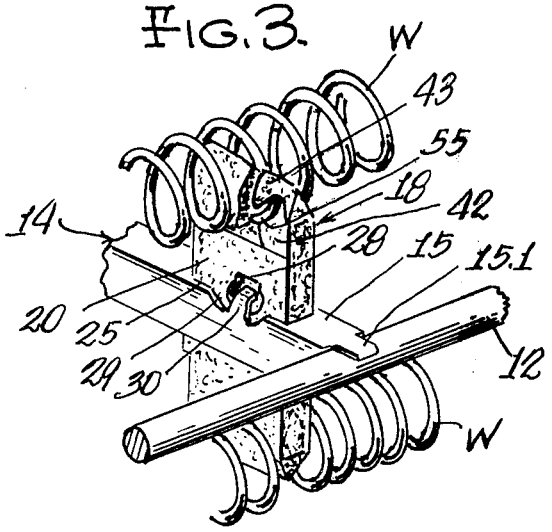
FIG. 3 is a fragmentary, perspective view showing a coil supported in accordance with my invention.
Figure 6:
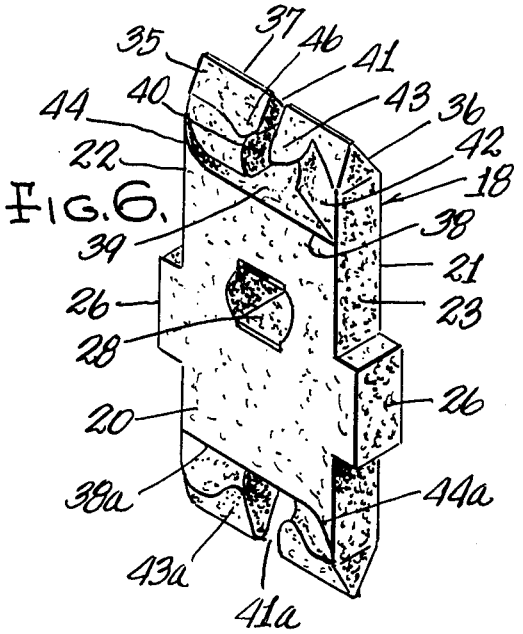
FIG. 6 is an enlarged, perspective view of a coil support.

The insulators 18 may be of the double-end type as illustrated, to accomodate heater coils in stacked relation, as seen in FIGS. 2 and 3, or they may be of a single-end type, such as if the part of the insulator below the dot-dash line 31 in FIG. 4 were omitted.

The two ends of each insulator 18 herein disclosed are identical. Each end has inwardly inclined side walls 35,36 which taper to a point 37 at the extremity of the insulator. A straight line 38 defines a ledge 39 which, at the central portion of the insulator, extends from the front side to the rear side of the insulator, and forms the bottom wall of a dome-shaped opening 40 which extends completely through the insulator. At its outer part, the dome-shaped opening communicates with a slot-like opening 41 which extends to the insulator extremity.

A wall surface 42 inclines from the insulator edge 23 inwardly toward the adjoining margin of the dome-shaped opening 40, but this wall surface is interrupted at the outer end of the insulator to form a hook-like projection 43 at an adjoining margin of the slot-like opening 41. The straight line 38 extends across the insulator and merges with an upwardly-curving line 44 and the ledge adjoining the latter is not as wide as the ledge 39, nor is the wall surface 45 set back as completely as the wall surface 42, and a relatively small hook-like projection 46 is formed adjoining the slot-like opening.

The foregoing was a description of the top end and forward side of the insulator in its position shown in FIGS. 3 through 6. The lower end and forward side of the insulator are similar except that it will be noted that the straight line 38*a* extends from the end 22 of the insulator, with the curved wall 44*a* at the end 23 of the insulator. Thus, the larger hook-like projection 43*a* is at the left hand of the slot-like opening 41*a*, as is the inwardly inclined wall 42*a*.

Figure 7:
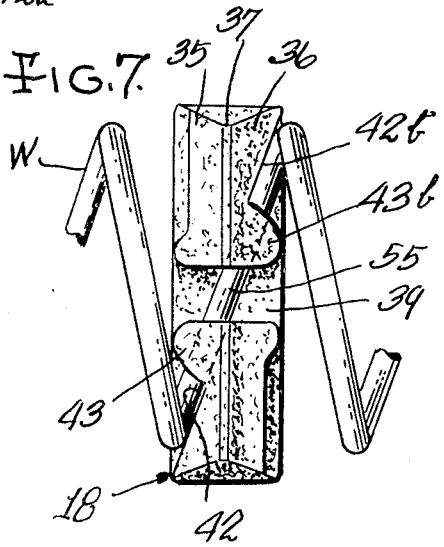
FIG. 7 is a fragmentary, top plan view of a coil support, showing the manner in which a convolution of the coil is supported thereby.

The top end and rearward side of the insulator 18 is exactly like that of the top end and forward side, except that the various configurations would appear in the position as if the insulator had been rotated 180 degrees about the longitudinal center line 50, shown in FIG. 4. Thus, as seen in FIG. 7, the larger hook-like projection 43*b* at the top end and rearward side is diagonally opposed to the projection 43 at the top end and forward side, as is the inclined surface 42*b*. It will be noted that the inclined surfaces 42 and 42*b* are so related as to be substantially parallel.

Figure 8:
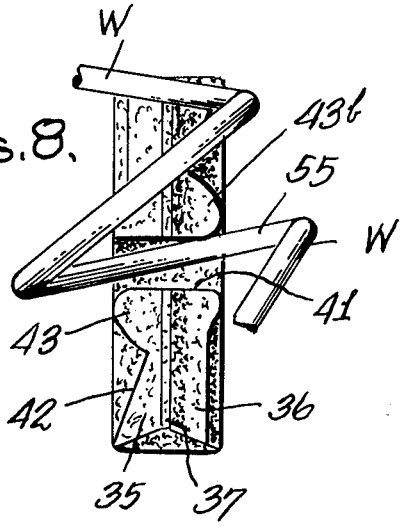
FIG. 8 is a view similar to FIG. 7 but showing an assembly step.

The coiled resistor wire W may be easily connected to an insulator end by twisting a portion of the coil to a position shown in FIG. 8 wherein a part 55 of a coil convolution is so disposed as to be able to be inserted through the slot-like opening 41 and into the dome-shaped opening 40 so that the part 55 rests upon or is adjacent to the ledge surface 39. The coil is then returned to a position shown in FIG. 7 wherein the longitudinal axis of the coil is substantially at right angles to the front and rear faces of the insulator. If the coil is twisted between cross arms for assembly with an insulator end, the inherent resiliency of the coil will automatically return the coil to the position shown in FIG. 7 after the convolution part 55 has been seated in the dome-shaped opening 40, and twisting force on the coil has been released.

As seen in FIG. 7, the inclined walls 42 and 42*b* form parallel surfaces which are inclined at substantially the same angle as the captured part of the convolution, so that the latter bears against respective parallel surfaces to restrict the coil from any substantial movement in an axial direction. It will be also seen in FIG. 7 that the hook-like projections 43 and 43*b* overlie the convolution part 55 to prevent its withdrawal through the slot-like opening 41. Thus, the coil is locked in position on the insulator end, and cannot be removed therefrom except by a reversal of the steps of its assembly with the insulator. Although FIG. 7 shows the convolution part 55 in close engagement with the surfaces 42, 42*b*, in normal practice there is a slight space therebetween to prevent hot spots. As seen in FIGS. 1 and 2, double-ended insulators enable two coiled resistor wires to be arranged in vertically stacked relation. The top resistor coil has its opposite ends connected to terminals 60 and 61 for connection to a source of electrical energy. Between the terminals, the resistor coil is reflexed to provide a plurality of reaches in side-by-side spaced relation. The lower resistor coil is supported by the lower end of the insulators in the same manner as the upper coil, and has its opposite ends connected to terminals 62 and 63.

I claim:

1. An open coil heater assembly, comprising, a metal support member, a helically-coiled resistance wire connected to and supported by said support member at a plurality of places, an insulator member at each of said places for electrically insulating said resistance wire from said support member, each insulator member being of one-piece molded refractory material and having a portion generally rectangular in transverse cross section to provide generally flat parallel opposed side surfaces, said insulator portion having a slot extending inwardly from an end thereof and transversely from one to the other of said opposed surfaces, said slot being sized and arranged to freely pass and receive a portion of the resistance wire between adjoining convolutions to permit said coiled resistance wire to extend transversely of and from said opposed surfaces and whereby said wire portion may be moved to position within said slot without hindrance from the defining walls of said slot, at least one of the opposed flat surfaces having a portion inclining transversely from a longitudinal edge thereof and inwardly toward said slot in a direction toward the opposed surface, and such surface having a hook-like projection extending therefrom to overlie the wire portion within said slot and thereby restrict its withdrawal from said slot.

2. The construction according to claim 1 wherein each insulator member is disposed within an opening in said support member and locked in place.

3. The construction according to claim 1 wherein said support member comprises a frame and a cross member of U-shaped cross section, the bight of the U having a rectangular slot of a size to pass the rectangular portion of said insulator member, the latter having an opening therein, and said cross member having a finger seating within said opening to hold said insulator member assembled with said cross member.

4. The construction according to claim 1 wherein said insulator portion end is wedge-shaped to facilitate insertion of said end portion between adjoining convolutions of said coiled resistance wire.

5. The construction according to claim 1 wherein said opposed side surfaces taper toward each other to a point at said insulator end portion to facilitate insertion of the latter between adjoining convolutions of said coiled resistance wire.

* * * * *